US007956545B2

(12) United States Patent
Kim et al.

(10) Patent No.: US 7,956,545 B2
(45) Date of Patent: Jun. 7, 2011

(54) FIELD EMISSION DEVICE

(75) Inventors: Kwang Bok Kim, Daejeon (KR); Dong Wook Yang, Suwon (KR)

(73) Assignee: Kumho Electric, Inc., Seoul (KR)

( * ) Notice: Subject to any disclaimer, the term of this patent is extended or adjusted under 35 U.S.C. 154(b) by 0 days.

(21) Appl. No.: 11/919,818

(22) PCT Filed: Oct. 31, 2007

(86) PCT No.: PCT/KR2007/005316

§ 371 (c)(1),
(2), (4) Date: Dec. 13, 2007

(87) PCT Pub. No.: WO2009/054557

PCT Pub. Date: Apr. 30, 2009

(65) Prior Publication Data

US 2010/0194295 A1 Aug. 5, 2010

(30) Foreign Application Priority Data

Oct. 26, 2007 (KR) ..... 10-2007-0108206

(51) Int. Cl.

| | |
|---|---|
| ***G09G 3/10*** | (2006.01) |
| ***H05B 39/00*** | (2006.01) |
| ***H05B 1/02*** | (2006.01) |
| ***H05B 7/00*** | (2006.01) |

(52) U.S. Cl. ..... 315/169.1; 315/167; 315/497; 313/308

(58) Field of Classification Search ..... 315/169.1, 315/169.3; 313/495, 497, 305, 309
See application file for complete search history.

(56) References Cited

U.S. PATENT DOCUMENTS

| | | | | |
|---|---|---|---|---|
| 5,801,486 | A * | 9/1998 | Johnson et al. | 313/495 |
| 6,040,973 | A * | 3/2000 | Okamoto et al. | 361/235 |
| 7,221,336 | B2 * | 5/2007 | Moon | 345/75.2 |
| 7,332,736 | B2 * | 2/2008 | Jin | 257/10 |
| 7,582,199 | B2 * | 9/2009 | Knop et al. | 205/104 |

* cited by examiner

*Primary Examiner* — Douglas W Owens
*Assistant Examiner* — Minh D A
(74) *Attorney, Agent, or Firm* — Robert L. Epstein; Epstein Drangel LLP

(57) ABSTRACT

The field emission device includes: a front substrate and a rear substrate which are disposed at a certain distance and opposite to each other; at least one or more cathode electrodes formed on the rear substrate; at least one or more gate electrodes formed to be distant from the cathode electrodes and to be insulated with the rear substrate; emitters formed on the upper surfaces of the cathode electrodes; an anode electrode formed on the front substrate toward the rear substrate side; a fluorescent layer formed on the anode electrode; a first voltage application circuit for applying an AC voltage to the anode electrode; and a second voltage application circuit for applying an AC voltage to the gate electrode, wherein the AC voltages being applied to the anode electrode and the gate electrode are synchronized.

3 Claims, 6 Drawing Sheets

PRIOR ART

[Fig. 3]
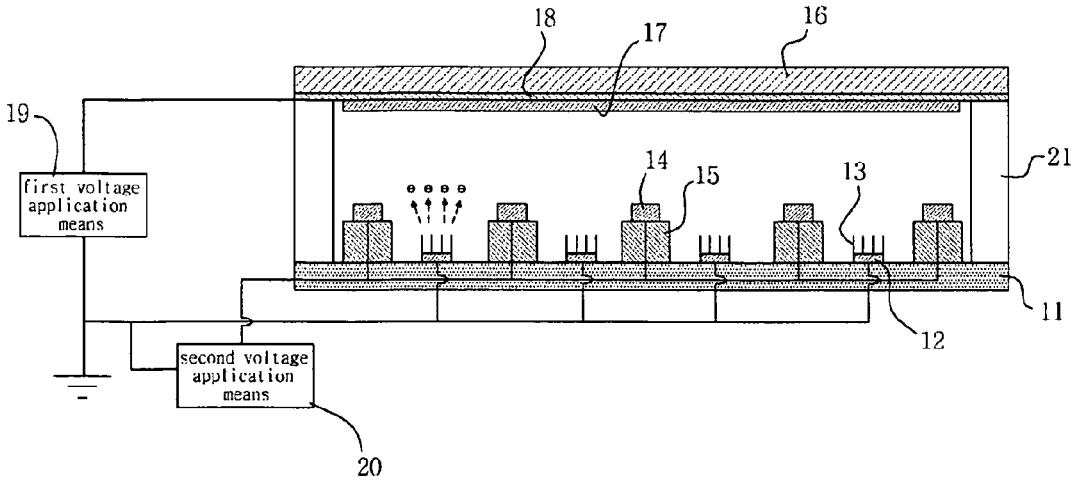
[Fig. 4]
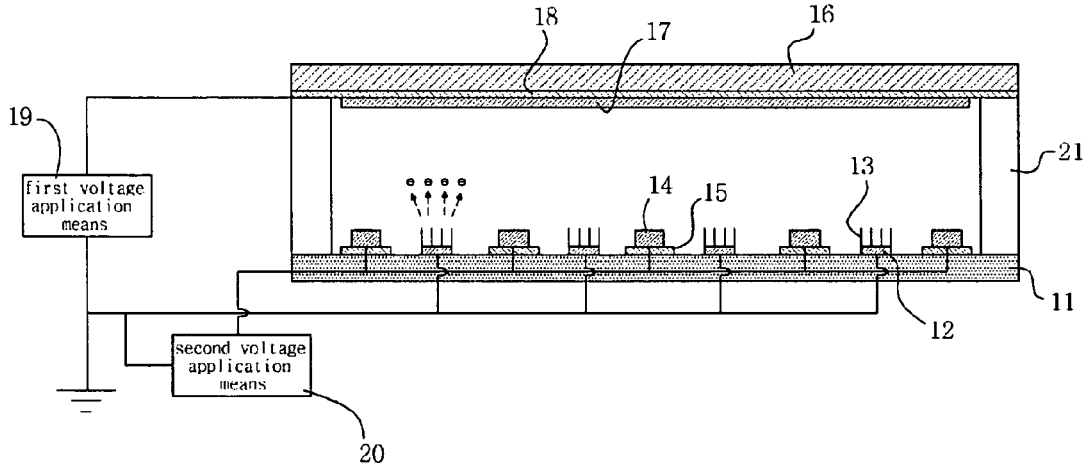

[Fig. 5]
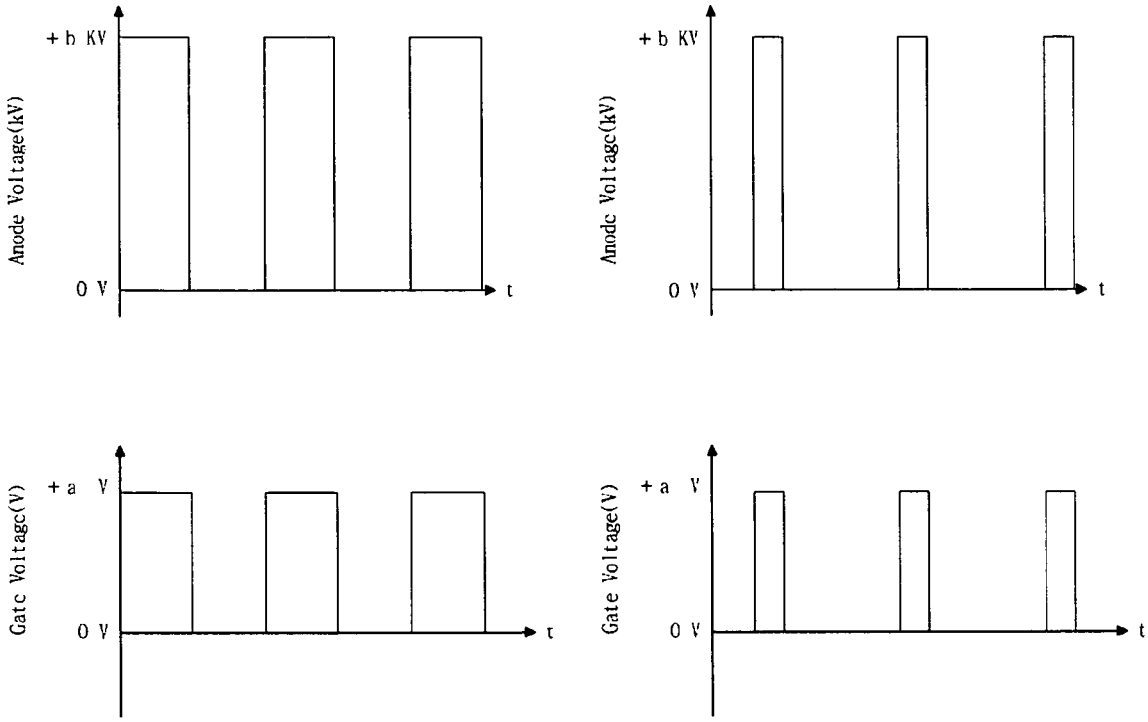
[Fig. 6]
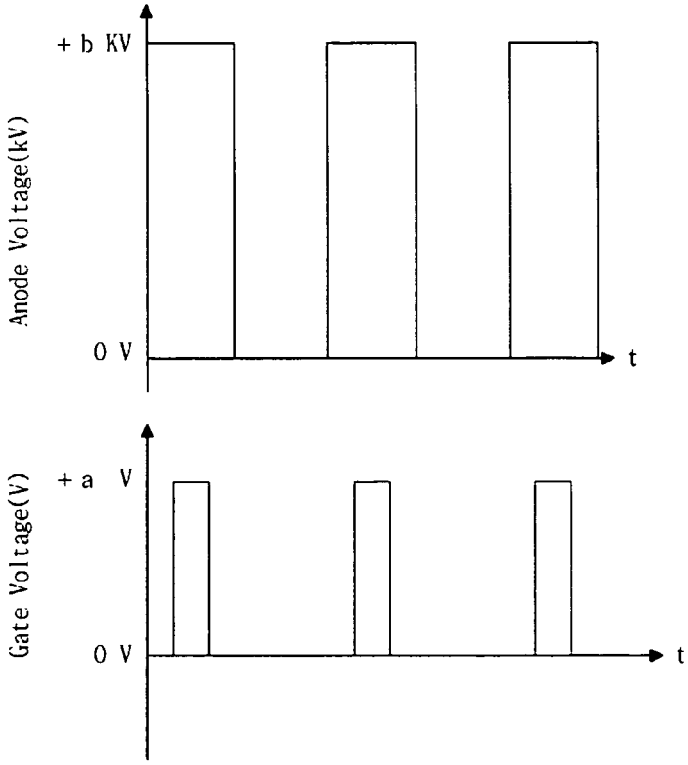

[Fig. 7]
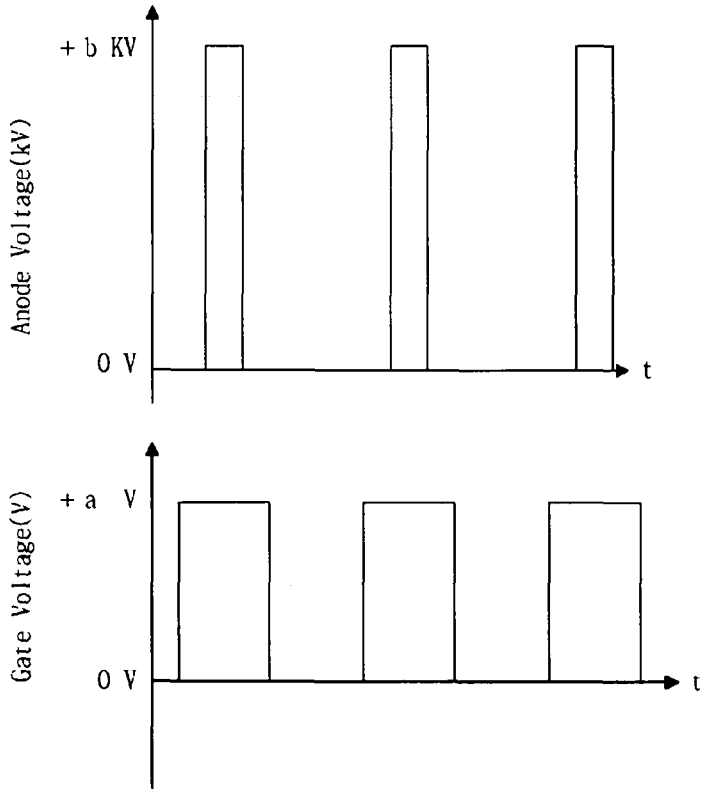
[Fig. 8]
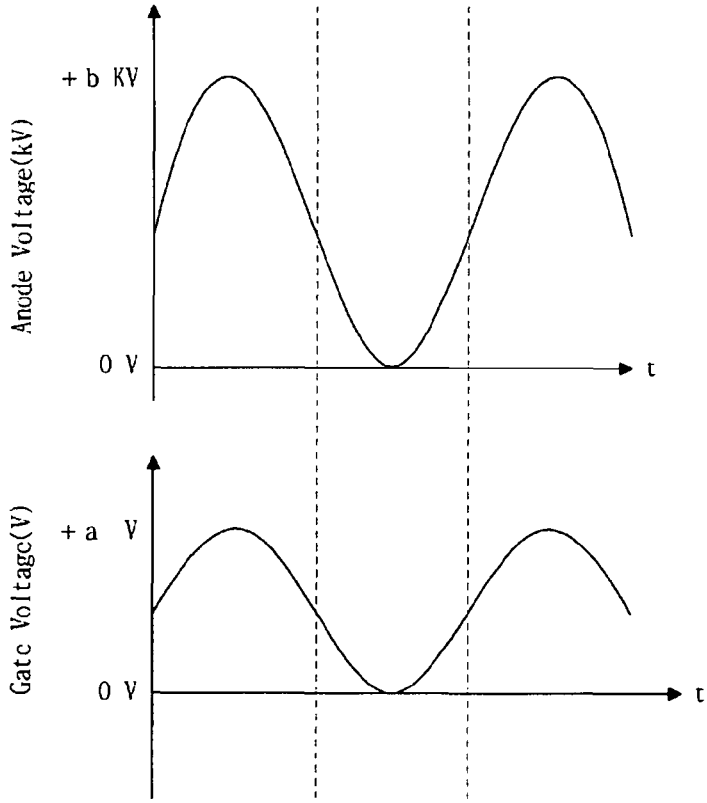

[Fig. 9]
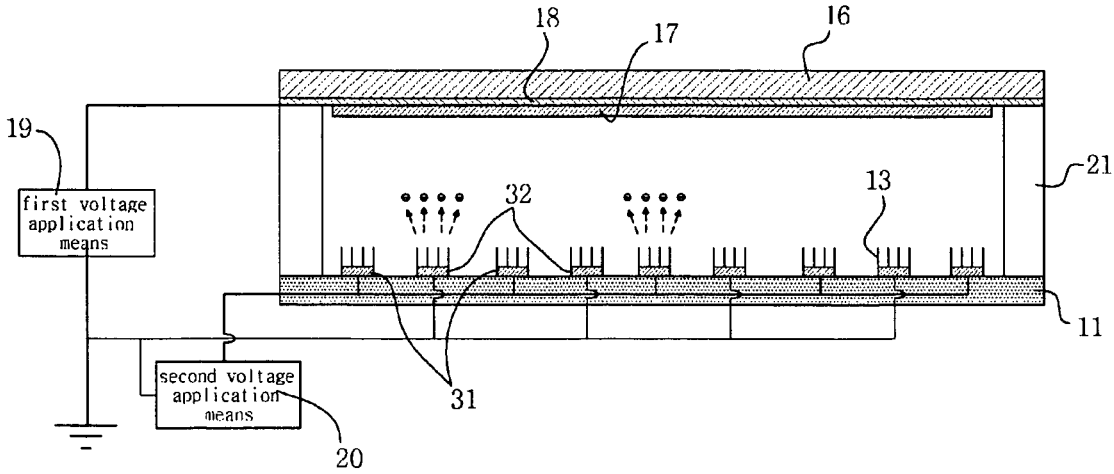
[Fig. 10]
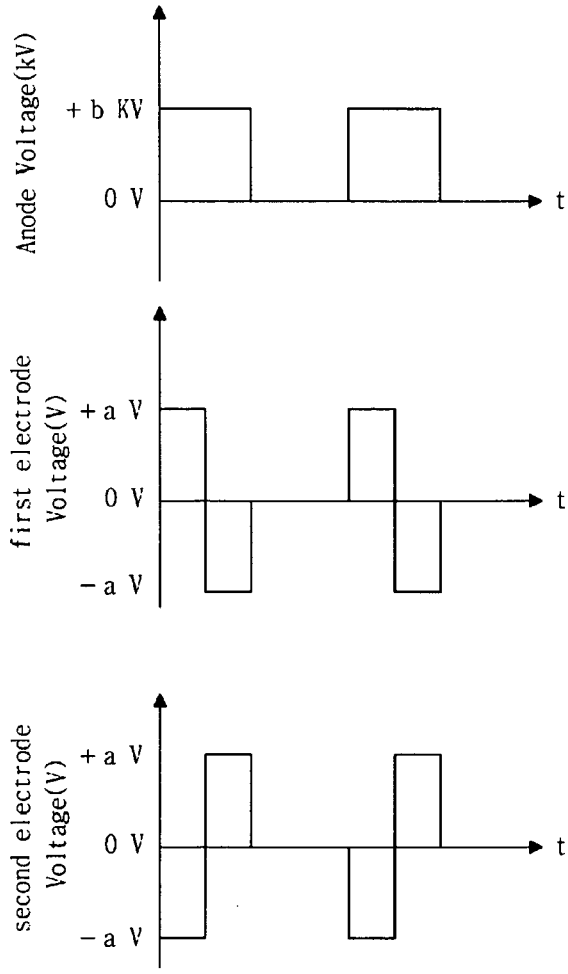

[Fig. 11]
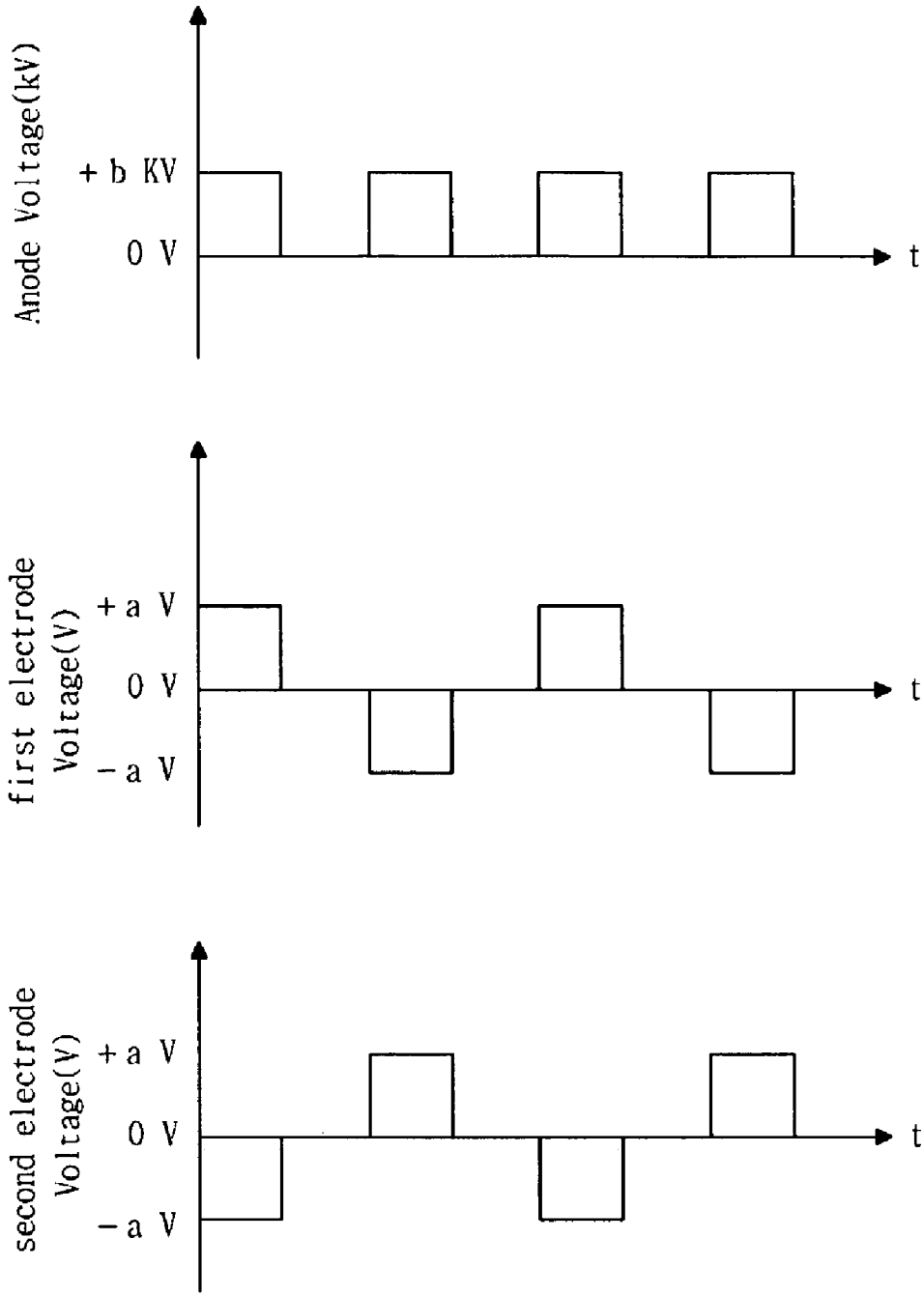

FIELD EMISSION DEVICE

This application is a 371 of PCT/KR07/05316 Oct. 31, 2007.

TECHNICAL FIELD

The present invention relates to a field emission device. More specifically, the present invention may prohibit unnecessary voltage from being applied to an anode electrode during non-operating time that no voltage is applied to a gate electrode to reduce driving power, prohibit electrons from being emitted with unnecessary high voltage which is applied to the anode electrode to increase luminous efficiency, and reduce a time that unnecessary high voltage is applied to the anode electrode to extend life time of the field emission device, by applying an AC voltage to the anode electrode to correspond to a time that voltage is applied to the gate electrode and a type of voltage which is applied to the gate electrode.

BACKGROUND ART

Recently, thin film display devices using field emission have been actively developed as light and thin flat-panel display devices which can substitute for conventional CRT (Cathode Ray Tube).

There are a diode structure and a triode structure in field emission devices. The diode structure has a benefit to be easily prepared and to permit high emission area, but need high driving power and has a problem of low luminous efficiency. Therefore, recently, the triode structure has been mainly used.

In the triode structure, in order to easily emit electrons from a field emitter material, an auxiliary electrode such as a gate electrode is formed to be at a distance of dozens nanometer (nm) to several centimeter (cm) from the cathode electrode.

FIG. 1 is a configuration view of the conventional field emission device having the triode structure. Referring to FIG. 1, cathode electrodes 2 are formed on a surface of a rear substrate 1, and emitters 3 made of carbon nanotubes are formed on the upper surfaces of cathode electrodes 2. Gate electrodes 4 are spaced apart from cathode electrodes 2 at a certain distance, and are formed on the rear substrate 1 via insulating layers 5. A front substrate 6, on which a fluorescent layer 7 and an anode electrode 8 are formed, is formed to be opposite to the rear substrate 1. The anode voltage and the gate voltage for driving the field emission device are supplied by a DC inverter 9 and an AC inverter 10, respectively.

FIG. 2 represents wave shapes of voltage being applied to the anode electrode 8 and the gate electrode 4 in the conventional field emission device with the triode structure. Electrons are emitted from the emitters 3 with an AC voltage applied to the gate electrode 4, and the emitted electrons are accelerated with high DC voltage applied to the anode electrode 8 to excite and radiate fluorescent material 7.

At this time, an AC voltage is applied to the gate electrode 4, while a DC voltage with high value is continuously applied to the anode electrode 8. Therefore, there is a problem that unnecessary power is consumed and a life time of the field emission device is reduced due to application of high voltage for a long time. Moreover, there is a problem that unnecessary electrons are emitted from emitters 3 with high anode voltage.

DISCLOSURE OF INVENTION

Technical Problem

The present invention is intended to solve the above problems, and may prohibit unnecessary voltage from being applied to an anode electrode during non-operating time that no voltage is applied to a gate electrode to reduce driving power, prohibit electrons from being emitted with unnecessary high voltage which is applied to the anode electrode to increase luminous efficiency, and reduce a time that unnecessary high voltage is applied to the anode electrode to extend life time of the field emission device, by applying an AC voltage to the anode electrode to correspond to a time that voltage is applied to the gate electrode and a type of voltage which is applied to the gate electrode.

Technical Solution

The field emission device of the present invention for achieving the above purposes comprises a front substrate and a rear substrate which are disposed at a certain distance and opposite to each other; at least one or more cathode electrodes formed on said rear substrate; at least one or more gate electrodes formed to be distant from said cathode electrodes and to be insulated with said rear substrate; emitters formed on the upper surfaces of said cathode electrodes; an anode electrode formed on said front substrate toward said rear substrate side; a fluorescent layer formed on said anode electrode; a first voltage application means for applying an AC voltage to said anode electrode; and a second voltage application means for applying an AC voltage to said gate electrode, wherein the AC voltages being applied to said anode electrode and said gate electrode are synchronized.

Further, the field emission device of the present invention comprises a front substrate and a rear substrate which are disposed at a certain distance and opposite to each other; at least one or more pairs of first electrode and second electrode formed on said rear substrate; emitters formed on the upper surfaces of said first electrode and said second electrode; an anode electrode formed on said front substrate toward said rear substrate side; a fluorescent layer formed on said anode electrode; a first voltage application means for applying AC voltage to said anode electrode; and a second voltage application means for alternately applying an AC voltage to said first electrode and said second electrode, wherein the AC voltage applied to said first electrode and the AC voltage applied to said second electrode is synchronized and polarities of the voltages are opposite to each other.

Preferably, the AC voltages being applied to said anode electrode, and said first electrode and said second electrode are square waves having the same frequency and duty ratio.

The AC voltages being applied to said anode electrode, and said first electrode and said second electrode may be square waves. The frequency of AC voltage being applied to said anode electrode may be twice as high as those of AC voltages applied to said first electrode and said second electrode.

Said emitter may consist of any one of metal, nanocarbon, carbide and nitride compounds.

Advantageous Effects

According to the field emission device of the present invention, since an AC voltage having square wave or sine wave shape is applied to the anode electrode to correspond to a time that voltage is applied to the gate electrode and a type of voltage which is applied to the gate electrode, no unnecessary voltage may be applied to an anode electrode during non-operating time that no voltage is applied to a gate electrode to reduce driving power, it may prohibit electrons from being emitted with unnecessary high voltage which is applied to the anode electrode to increase luminous efficiency, and it may reduce a time that unnecessary high voltage is applied to the anode electrode to extend life time of the field emission device.

BRIEF DESCRIPTION OF THE DRAWINGS

FIG. 3 is a configuration view of the field emission device according to the present invention.

FIG. 4 is a configuration view of the field emission device composed in a manner of lateral gate.

FIG. 5 represents waveforms of anode voltage and gate voltage having a square wave (the same duty ratio).

FIG. 6 represents waveforms of anode voltage and gate voltage having a square wave (different duty ratios).

FIG. 7 represents waveforms of anode voltage and gate voltage having a square wave (different duty ratios).

FIG. 8 represents waveforms of anode voltage and gate voltage having a sine wave.

FIG. 9 is a configuration view of field emission device of lateral gate structure having dual emitters.

FIG. 10 represents waveforms of square wave AC voltage supplied by voltage application means in the lateral structure having dual emitters.

FIG. 11 represents waveforms of square wave AC voltage supplied by voltage application means in the lateral structure having dual emitters.

MODE FOR THE INVENTION

Figure 1:
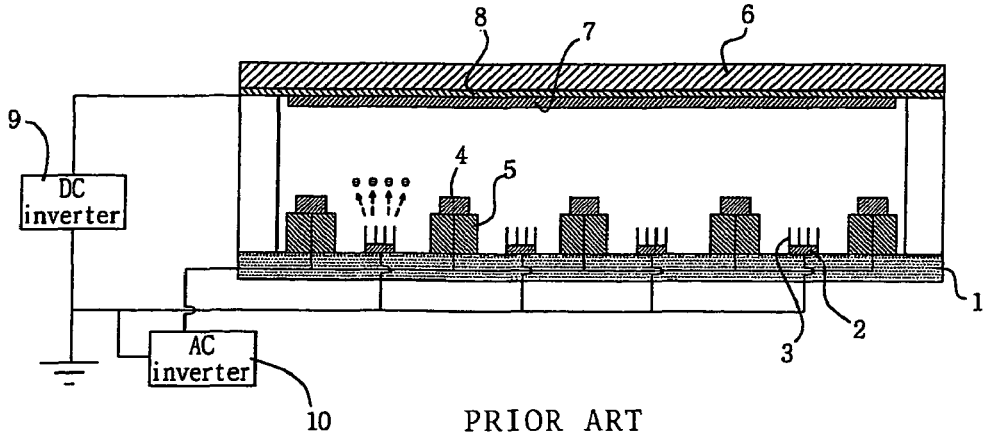
FIG. 1 is a configuration view of a conventional field emission device having the triode structure.
Figure 2:
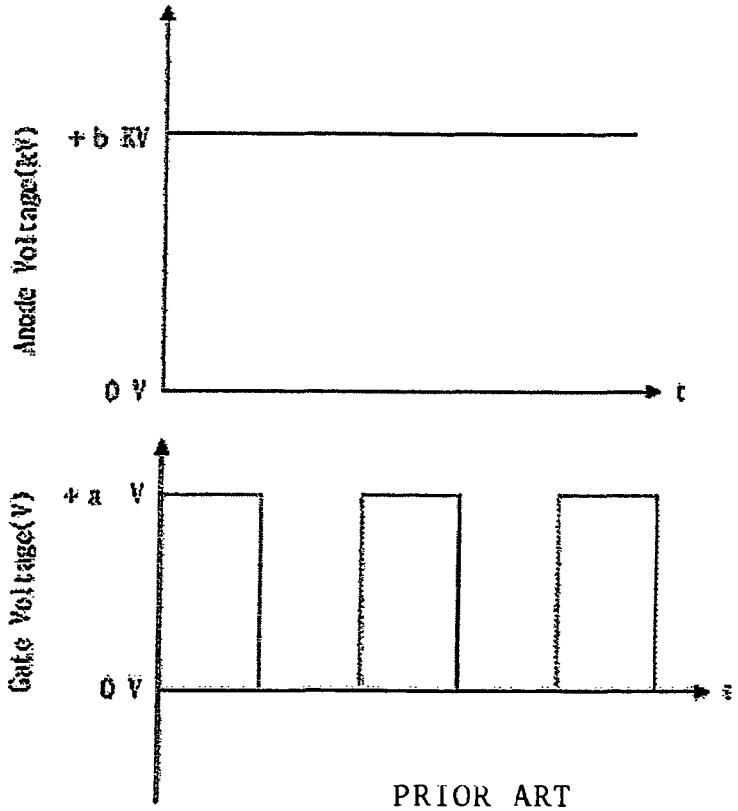
PRIOR ART Fig. 2
FIG. 2 represents waveforms of voltage applied to anode electrode and gate electrode in the conventional field emission device having the triode structure.

Hereinafter, preferred examples of the present invention are explained in detail with reference to the attached drawings.

FIG. 3 is a structural view of the field emission device according to the present invention, and represents normal top gate structure in which gate electrodes 14 are higher than cathode electrodes 12.

Referring to FIG. 3, a front substrate 16 and a rear substrate 11 are at a certain distance from each other and are disposed to be opposite to each other. The front substrate 16 and the rear substrate 11 are insulating substrates which can be made of glass, alumina, quartz, silicon wafer and the like. However, considering preparation processes and enlargement of area, it is preferred to use a glass substrate as the front and rear substrates.

On the rear substrate 11, at least one or more cathode electrodes 12 made of metal are formed. Generally, the cathode electrode 12 has a stripe shape.

On the upper surface of the cathode electrode 12, an emitter 13 emitting electrons is formed. The emitter 13 may be formed with any one of metal, nanocarbon, carbide, and nitride compounds.

On the rear substrate 11, at least one or more insulators 15 are formed between cathode electrodes 12, in a state where the insulators 15 and the cathode electrodes 12 are spaced from each other. Gate electrodes 14 are formed on the upper surfaces of insulators 15.

On the front substrate 16 disposed to be opposite to the rear substrate 11, an anode electrode 18 facing the rear substrate 11 is formed. Generally, the anode electrode 18 is formed with a transparent conductive layer such as ITO (Indium Tin Oxide) layer.

The anode electrode 18 is covered with a fluorescent layer 17 in which R, G, and B fluorescent materials are mixed at a certain ratio.

A frit glass 21 is formed between the rear substrate 11 and the front substrate 16 for supporting the substrates and maintaining vacuum air tightness state.

A first voltage application means 19 and a second voltage application means 20 supply the AC voltage for driving the field emission device according to the present invention. The conventional AC inverters may be utilized as the first and second voltage application means. The first voltage application means 19 applies the AC voltage to the anode electrode 18, and the second voltage application means 20 applies the AC voltage to the gate electrodes 14.

Here, as shown in FIG. 4, the field emission device according to the present invention may be composed in a manner of lateral gate that gate electrodes 14 are positioned at the side of cathode electrodes 12 by regulating thickness of insulators 15.

Hereinafter, a method of driving the field emission device according to the present invention is explained in detail with reference to FIGS. 5 to 7.

FIGS. 5 to 7 represent waveforms of the anode voltage and the gate voltage having a square wave. The anode voltage refers to a voltage being applied to the anode electrode 18 via the first voltage application means 19, and the gate voltage refers to a voltage being applied to the gate electrode 14 via the second voltage application means 20. 0 (zero) volt refers to voltage of nodes that the first voltage application means 19 and the second voltage application means 20 are commonly earthed. Generally, the peak value of anode voltage is higher than that of gate voltage.

Referring to FIGS. 5 to 7, the AC voltages supplied by the first voltage application means 19 and the second voltage application means 20 are mutually synchronized. Here, the term "synchronization" means that the AC voltages supplied by the first voltage application means 19 and the second voltage application means 20 are in harmonic relation with each other. For purposes of the present invention to prohibit unnecessary voltage from being applied to the anode electrode 18, it is preferable that the AC voltages supplied by the first voltage application means 19 and the second voltage application means 20 have the same frequency.

However, electrons emitted from the emitters 13 by the voltage supplied from the first voltage application means 19 should be accelerated toward the anode electrode 18 by the voltage supplied by the second voltage application means 20. Therefore, it should be noted that the term "synchronization" means that the AC voltages supplied by the first voltage application means 19 and the second voltage application means 20 are in harmonic relation with each other, durations of voltage pulses supplied by the first voltage application means 19 and the second voltage application means 20 are overlapped in at least some section of time.

FIG. 5 is waveforms showing that the square wave AC voltages having the same frequency and duty ratio are supplied to the anode electrode 18 and the gate electrodes 14 to improve the efficiency of field emission device. Here, to optimize the efficiency, it is preferred to make the pulse duration sections of anode voltage and gate voltage identical. However, as shown in FIG. 5, the size of duty ratio may be also changed if needed.

In a case where materials constituting the anode electrode 18 and the gate electrodes 14 have different reaction times, duty ratios of the anode voltage and the gate voltage may be varied to optimize the efficiency of field emission device, as shown in FIGS. 6 to 7. That is, it is preferred to apply first voltage to the electrode made of materials having slow reaction time. As a result, the duty ratios of anode voltage and gate voltage may be varied.

FIG. 6 is waveforms showing that the duty ratio of the anode voltage is larger than that of the gate voltage, and showing that the time section of which pulses are maintained in the gate voltage is included in the time section of which pulses are maintained in the anode voltage. Contrary to FIG. 6, FIG. 7 is waveforms showing that the duty ratio of the gate voltage is larger than that of the anode voltage.

In the above, the present invention is explained by restricting the waveform of AC voltage to square wave. But, as shown in FIG. 8, sine waves may be also applied. Here, it is preferred that sine wave voltages supplied by the first voltage application means 19 and the second voltage application means 20 have the same frequency. Also, preferably, the above two sine wave voltages have the same phase. If the waveform of voltage supplied by the first voltage application means 19 is a square wave and a sine wave, there is a benefit that the average power for driving field emission devices is reduced, as compared with the conventional cases in which the DC voltage is supplied.

FIG. 9 is a view showing the field emission device according to another embodiment of the present invention, and shows a lateral gate structure of the field emission device having dual emitters.

On the rear substrate 11, at least one or more pairs of first electrode 31 and second electrode 32 are formed. On the upper surfaces of the first electrode 31 and the second electrode 32, emitters 13 are formed.

That is, unlike the structures shown in FIGS. 3 and 4, in this structure, imbalance of brightness may be solved, without distinguishing, in fact, between the gate electrode 14 and the cathode electrode 12.

FIG. 10 is waveforms of square wave AC voltages supplied by the voltage application means in the lateral gate structure having dual emitters. Voltages, of which peak values and amplitudes are the same but polarities are mutually reversed, are alternately applied to the first electrodes 31 and the second electrodes 32. Therefore, since the first electrodes 31 serve actually as the gate electrode and the second electrodes 32 serve as the cathode electrode during a time that the voltage of the first electrodes 31 is relatively high, electrons are emitted from emitters 13 formed on the upper surfaces of the second electrodes. On the contrary, in a case where the voltage of the second electrodes 32 is relatively high, the first electrodes 31 serve actually as the cathode electrode, so that electrons are emitted from emitters 13 formed on the upper surfaces of the first electrodes 31.

Here, as shown in FIG. 10, it is preferred that the frequency of anode voltage is the same as that of voltage applied to the first electrodes 31 and the second electrodes 32. However, as shown in FIG. 11, the frequency of anode voltage may be also twice as high as that of voltage applied to the first electrodes 31 and the second electrodes 32.

INDUSTRIAL APPLICABILITY

According to the field emission device of the present invention, since an AC voltage having square wave or sine wave shape is applied to the anode electrode to correspond to a time that voltage is applied to the gate electrode and a type of voltage which is applied to the gate electrode, no unnecessary voltage may be applied to an anode electrode during non-operating time that no voltage is applied to a gate electrode to reduce driving power, it may prohibit electrons from being emitted with unnecessary high voltage which is applied to the anode electrode to increase luminous efficiency, and it may reduce a time that unnecessary high voltage is applied to the anode electrode to extend life time of the field emission device.

The invention claimed is:

1. A field emission device comprising a front substrate and a rear substrate which are disposed at a certain distance and opposite to each other; at least one or more pairs of first electrode and second electrode formed on said rear substrate; emitters formed on the upper surfaces of said first electrode and said second electrode; an anode electrode formed on said front substrate toward said rear substrate side; a fluorescent layer formed on said anode electrode; a first voltage application means for applying AC voltage to said anode electrode; and a second voltage application means for alternately applying an AC voltage to said first electrode and said second electrode, wherein the AC voltage applied to said anode electrode, and said first and second electrodes are synchronized and polarities of the voltages applied to said first and second electrodes are opposite to each other, and wherein the AC voltages being applied to said anode electrode, and said first electrode and said second electrode are square waves having the same frequency and duty ratio.

2. A field emission device comprising a front substrate and a rear substrate which are disposed at a certain distance and opposite to each other; at least one or more pairs of first electrode and second electrode formed on said rear substrate; emitters formed on the upper surfaces of said first electrode and said second electrode; an anode electrode formed on said front substrate toward said rear substrate side; a fluorescent layer formed on said anode electrode; a first voltage application means for applying AC voltage to said anode electrode; and a second voltage application means for alternately applying an AC voltage to said first electrode and said second electrode, wherein the AC voltages applied to said anode electrode, and said first electrode and said second electrode are synchronized, and polarities of voltages applied to said first and second electrodes are opposite each other, wherein the AC voltages being applied to said anode electrode, and said first and second electrode are square waves and the frequency of AC voltage being applied to said anode electrode is twice as high as those of AC voltages applied to said first electrode and said second electrode.

3. The field emission device of claim 2, wherein said emitter is made of any one of metal, nanocarbon, carbide and nitride compounds.

* * * * *